United States Patent [19]

Kaji

[11] Patent Number: 4,790,124

[45] Date of Patent: Dec. 13, 1988

[54] ARTICLE PACKAGING APPARATUS

[75] Inventor: Kazumi Kaji, Osaka, Japan

[73] Assignees: Kabushiki Kaisha Asada, Tokyo; Coil Master Kogyo Kabushiki Kaisha, Osaka, both of Japan

[21] Appl. No.: 84,997

[22] Filed: Aug. 13, 1987

[30] Foreign Application Priority Data

Mar. 30, 1987 [JP] Japan ..... 62-48427[U]

[51] Int. Cl.[4] ..... B65B 9/12; B65B 39/06

[52] U.S. Cl. ..... 53/552; 53/576

[58] Field of Search ..... 53/373, 551, 552, 576, 53/451, 450

[56] References Cited

U.S. PATENT DOCUMENTS

| | | | |
|---|---|---|---|
| 3,425,185 | 2/1969 | Samways et al. | 53/552 |
| 3,522,689 | 8/1970 | Wylie et al. | 53/552 |
| 3,629,987 | 12/1971 | Klofenstein et al. | 53/552 |
| 3,892,060 | 7/1975 | Stanley | 53/552 X |
| 4,423,585 | 1/1984 | Monsees et al. | 53/551 X |
| 4,495,751 | 1/1985 | Galbiati | 53/576 |
| 4,599,850 | 7/1986 | Kopp | 53/551 X |
| 4,663,917 | 5/1987 | Taylor et al. | 53/552 |
| 4,676,051 | 6/1987 | Hoskinson et al. | 53/552 X |

*Primary Examiner*—James F. Coan
*Assistant Examiner*—Steven P. Weihrouch
*Attorney, Agent, or Firm*—Ladas & Parry

[57] ABSTRACT

An article packaging apparatus with a cylindrical cassette having a tube made of resin fitted on the outer peripheral surface thereof is mounted below a charging station for charging articles. Heated press heads for heating and fusing the resin tube are arranged below the cassette. The heated press heads are moved from a standby position remote from the resin tube to a clamping position for clamping the tube. The heated press heads are then lowered a predetermined distance from the clamping position in order to pull the resin bag and move the heated press heads to a fusing position for fusing said tube. The heated press heads are lowered a short distance from the fusing position and the heated press heads are moved to a separating position for separating an individual bag from the resin tube.

5 Claims, 4 Drawing Sheets

ARTICLE PACKAGING APPARATUS

FIELD OF THE INVENTION

This invention relates to an article packaging apparatus for packaging articles such as springs or foodstuffs in vinyl bags.

BACKGROUND OF THE INVENTION

When packaging the above-mentioned articles, the conventinal practice is to enclose a predetermined number of the articles in the vinyl bag and then seal the bag by heating and fusing the opening of the vinyl bag using a sealing apparatus having fusing means such as a heater. Thus, the vinyl bag sealing operation is performed through human intervention. Consequently, there is the danger of the operator being burned during the fusing operation, so that safety measures are required at such time.

Another problem is that sealing errors tend to occur when the vinyl bag clamping position shifts during fusing or when the opening of the vinyl bag is not clamped sufficiently.

Furthermore, when packaging the above-mentioned articles continuously, a predetermined number of the articles are enclosed in a vinyl tube. While this is being done, the tube is formed into interconnected vinyl bags by fusing the tube at predetermined intervals, after which the sealed portions are severed by a cutter or the like to separate the tube into individual bags. However, since each sealed portion must be cut individually for each and every bag, the cutting operation is laborious and a continuous packaging operation cannot be carried out.

In addition, since the individual bags are separated from the tube by the cutting operation involving human intervention, the cutting position readily shifts. The resulting cutting error can cause the articles to spill out of the erroneously cut portion on the side of the vinyl tube or on the side of the individual bag, thus causing articles to be lost.

BRIEF SUMMARY OF THE INVENTION

The primary object of the present invention is to provide an article packaging apparatus specially constructed such that after a tube made of resin is fused, heat press plates are lowered a short distance to pull and tear off an individual bag to separate it from the tube, whereby the labor of severing sealed portions by a cutter or the like can be eliminated and individual bags can be reliably separated from the resin tube in a sealed state, thereby enabling a continuous packaging operation to be carried out.

The present invention is characterized by an article packaging apparatus in which a cylindrical cassette having a tube made of resin loaded thereon is mounted below a charging section for charging articles, heat press heads for heating and fusing the resin tube are arranged below the cassette, and moving means is provided for moving the heat press heads from a standby position remote from the resin tube to a clamping position for clamping the tube, lowering the heat press heads a predetermined distance from the clamping position in order to pull the resin bag and moving the heat press heads to a fusing position for fusing the tube, and lowering the heat press heads a short distance from the fusing position and moving the heads to a separating position for separating an individual bag from the resin tube.

According to the invention, articles charged into the charging section flow downwardly through the interior of the cassette mounted below the charging section. The articles are supplied to the interior of the resin tube by dropping into the same, after which the moving means moves the heat press heads to the clamping position, where a portion of the resin tube above a position at which the articles are enclosed is clamped. With the tube in the clamped state, the heat press heads are lowered a predetermined distance and, at the same time, the resin tube is pulled off the cassette by a length equivalent to one individual bag. The clamped portion of the resin tube clamped by the heat press heads is then heated and fused at the fusing position. Immediately after being fused the resin tube is lowered a short distance by the heat press heads in the clamped state to tear off an separate and individual bag from the resin tube, after which the heat press heads are withdrawn and the individual bag is carried out to the next process. The tearing process which renders a fully sealed container at one end and a bottom sealed tube at the other end results from the weakened line of juncture caused by the heat from the press plates which line is pulled in one direction by movement of the heat press plates away from the cassette and pulled in the opposite direction by the shape of the cassette and the retainer ring holding the resin tube to the cassette. Meanwhile, the heat press heads are returned to their initial positions for clamping the resin tube.

In accordance with the invention, one individual bag is separated in a fully sealed condition while the resin tube proper is left in a sealed state that allows it to receive the articles. This eliminates the labor involved in cutting sealed portions by a cutter or the like and makes it possible to reliably separate an individual bag from the resin tube in a state where both are sealed. Moreover, since human intervention is not required, there is no risk of articles being lost due to cutting errors and there are no sealing errors. At the same time, since the fusing and separating processes are performed by mechanical operations, a continuous packaging activity can be performed quickly and accurately.

Furthermore, since it is possible for the next batch of articles to be received by fusing the resin tube, separating an individual bag from the tube and receiving the articles in the tube can be performed simultaneously. Thus, the efficiency of the packaging operation can be raised by superimposing these packaging cycles.

Also, articles can be packaged continuously by charging a predetermined number of the articles into the cassette, so that the time required from processing of the articles to delivery thereof can be greatly reduced, thus raising the efficiency of the operation during packaging.

DETAILED DESCRIPTION OF THE INVENTION

An embodiment of the invention will now be described in detail in conjunction with the drawings.

The drawings illustrate an article packaging apparatus for packaging springs serving as one example of the articles that can be packaged.

Figure 1:
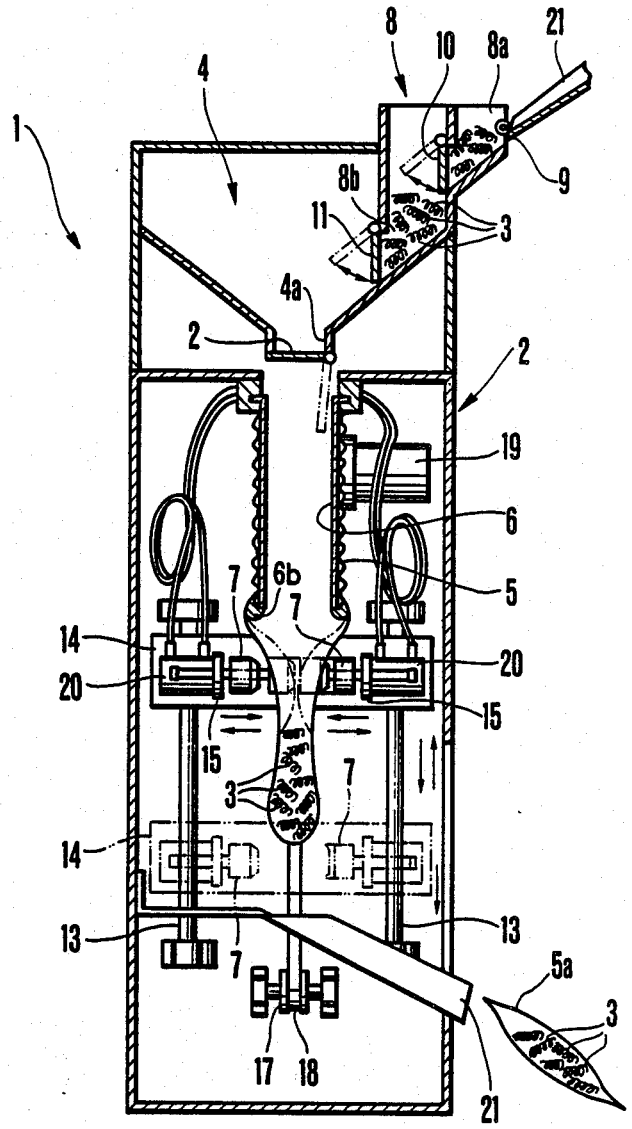
FIG. 1 is a longitudinal sectional front view of the article packaging apparatus.
Figure 2:
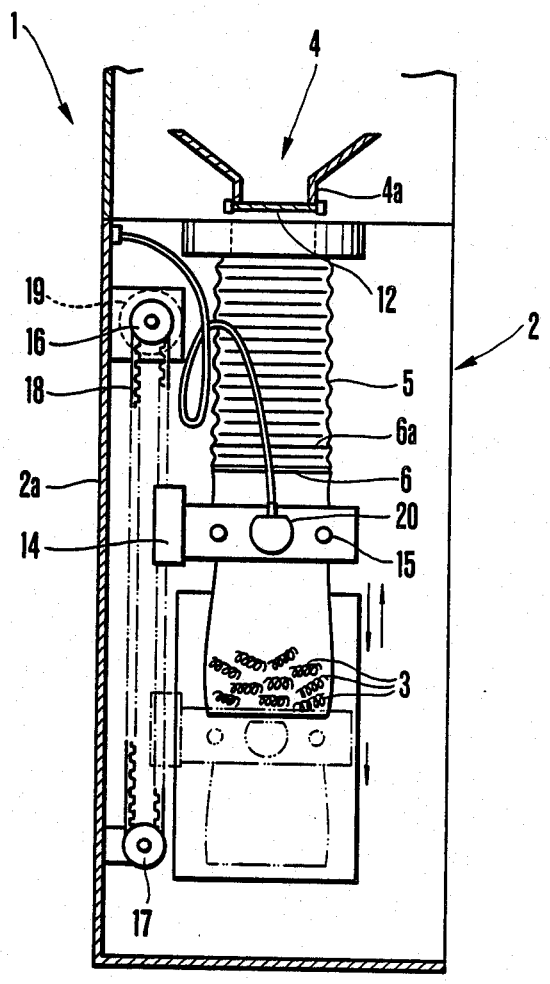
FIG. 2 is a longitudinal sectional side view of the article packaging apparatus.
Figure 3A:
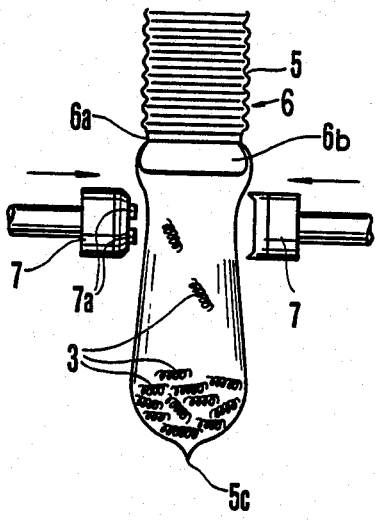
FIGS. 3(*a*)–(*d*) are views for describing the operation.
Figure 3C:
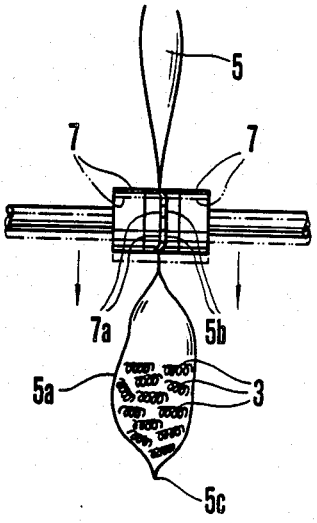
Figure 3B:
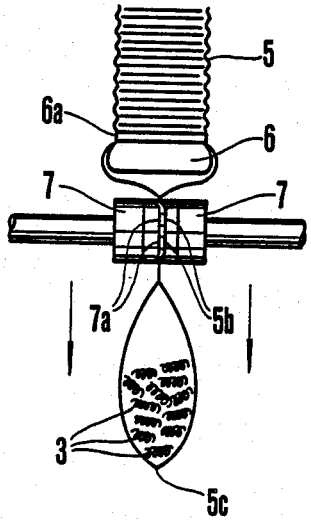
Figure 3D:
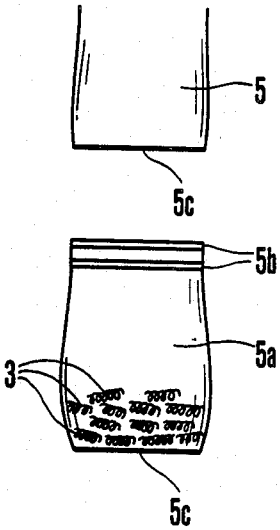
Figure 4:
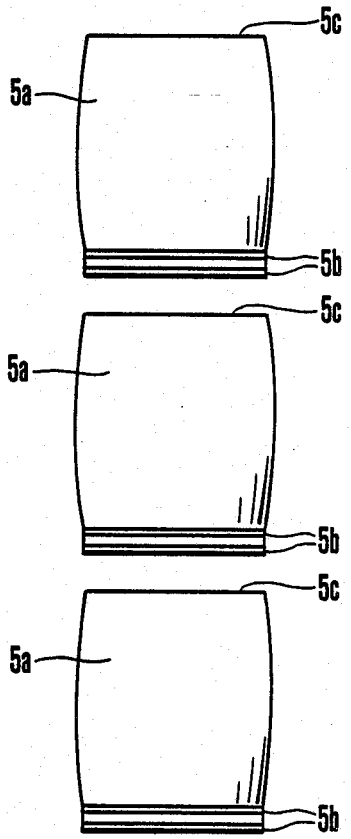
FIG. 4 is a plan view of individual bags formed through the operation illustrated in FIG. 3.

In FIGS. 1 and 2, the article packaging apparatus is shown to include a charging section 4 provided on the upper portion of the apparatus main body 2 for charging articles 3. A cassette 6 with a bulbous base 6*b* is shown having a transparent tube 5 made of resin fitted thereon is mounted below the charging section 4. Arranged below the cassete 6 are heat press heads 7, 7 for heating and fusing the resin tube 5.

As shown in FIG. 1, a hopper 8 for supplying a predetermined number of springs 3 to the charging section 4 is disposed above the charging section 4. The hopper 8 has a charge port 8*a* to which is secured an optical sensor 9 (or proximity switch) for counting the number of springs 3 charged. A first shutter 10 capable of opening and closing freely is pivotally attached to the intermediate portion of the hopper 8 internally thereof, and a second shutter 11 capable of opening and closing freely is pivotally attached to the hopper on the front side of an outflow port 8*b* at the lower portion of the hopper.

As shown in FIG. 2, the resin tube 5 is fitted form its open upper end onto the outer peripheral surface of the cylindrically formed cassette 6 and is bunched up on the cassette in the longitudinal direction thereof. Thereafter, a retaining ring 6*a* is fitted onto the outer surface of the resin tube 5 to hold the tube on the outer peripheral surface of the cassette 6. The cassette 6 is loaded vertically with its open upper end in communication with an outflow port 4*a* formed on the lower portion of the charging section 4.

A third shutter 12 capable of opening and closing freely is pivotally attached to the lower end of the outflow port 4*a*.

As shown in FIGS. 1 and 2, heat press heads 7, 7 are operatively associated with two guide shafts 13, 13 mounted on the side wall 2*a* of the apparatus below the charging section 4 so as to extend in parallel in the vertical direction. A slide plate 14 is slidably mounted on these two guide shafts 13, 13 and has support plates 15, 15 projecting from both side portions of the front surface thereof. The heat press plates 7, 7 are supported on the opposing faces of the support plates 15, 15 so as to be slidable from a standby position, which is remote from the resin tube 5, to a clamping position at which the resin tube 5 is clamped.

As shown in FIG. 2, the slide plate 14 is fixed to one end of a belt 18 stretched between a gear 16 pivotally attached to the apparatus wall surface 2*a* at an upper position thereof and a gear 17 pivotally attached to the wall surface at a lower position thereof. The upper gear 16 is rotated by a drive motor 19 secured to the side wall 2*a*, whereby the belt 18 is circulated back and forth to slide the slide plate 14 up and down between the aforementioned clamping position and fusing position located a predetermiined distance farther down.

As shown in FIG. 1, both of the heat press plates 7, 7 are slid reciprocally in a direction away from the resin tube 5 and in a direction to clamp the tube by air cylinders 20, 20 fixedly secured to the support plates 15, 15. Further, as shown in (*a*) of FIG. 3, electrical heating plates 7*a*, 7*a* are secured to the clamping surface of one of the heat press plates 7 at upper and lower positions thereof, and the clamping surface of the other of the heat press plates 7 is formed to mate with the opposing clamping surface.

The operation of the article packaging apparatus 1 constructed as set forth above will now be described.

As shown in FIG. 1, springs 3 successively charged into the hopper 8 via a chute 21 are pooled in the hopper while being counted by the optical sensor 9 secured to the charge port 8*a*.

When the number of springs counted by the optical sensor 9 attains a count set to e.g. 100, the first shutter 10 pivotally attached to the intermdediate portin of the hopper is opened to allow the springs 3 to flow down to the second shutter 11, after which the first shutter 10 is closed so that the next charge of springs 3 can be counted until the predetermined value is reached.

This is followed by opening the second shutter 11 to drop and supply the springs to the third shutter 12. Next, the third shutter 12 is opened to allow the predetermined number of springs 3 to flow down into the interior of the cassette 6 loaded below the charging section 4. These springs drop into resin tube 5 fitted onto the cassette 6.

Thereafter, as shown in (*a*) of FIG. 3, the air cylinders 20, 20 are actuated to slide the heat press heads 7, 7 in a direction (indicated by the arrows) that will cause them to clamp the resin tube 5. Then, as shown in (*b*) of FIG. 3, the tube is clamped at a position below cassette 6 at a portion thereof above where the springs 3 are contained, and the drive motor 19 is started to lower the slide plate 14 a predetermined distance (in the direction of the arrows) to the fusing position while the tube remains in the clamped state. This then draws down more tubing to be filled. The length of one individual bag 5*a* of the resin tube 5, equivalent to the descent of the slide plate 14 is pulled off the cassette 6 on which the tube is fitted.

Next, as shown in (*c*) of FIG. 3, the electrical heating plates 7*a*, 7*a* provided on one of the heat press plates 7 are energized at the position obtained by being lowered the aforementioned predetermineded distance, whereby the clamped portion of the resin tube 5 is heated and fused. The portion of the tube in contact with the electric heating plates is not the only portion of the tube which is heated. Small areas above and below the heating plates are also heated and sealed.

Immediately after the fusing operation, the slide plate 14 is lowered a short distance (in the direction of the arrows) to a separating position, as shown by the phantom line in (*c*) of FIG. 3, while the resin tube 5 remains in the clamped states. As the upper edge of the sealed portion 5*b* is in a softened state, the opposing stresses on that portion due to the downward movement of the sliding plate and the upward tension due to the retaining ring 6*a* and bulbous portion 6*b*, the tube is torn away as shown in (*d*) of FIG. 3.

More specifically, the main body side of the resin tube 5 takes on a state in which a sealed portion 5*c* is left remaining at the lower portion thereof so that the tube can receive the springs 3. The individual bag 5*a* torn off from the tube is in a completely sealed state at its upper and lower portions.

This is followed by actuating the air cylinders 20, 20 to move the heat press heads 7, 7 away from each other, whereupon the separated individual bag 5*a* drops into a chute 21 so as to be carried out to the next process.

At the same time, a predetermined number of the springs 3 are dropped into and received by the resin tube 5.

Meanwhile, the drive motor 19 is rotated in the reverse direction to elevate the slide plate 14, whereby the two heat press plates 7, 7 are returned to their initial positions for clamping the resin tube 5.

Thus, immediately after the resin tube 5 is fused, the two heat press plates 7, 7 are lowered a short distance to tear off the individual bag 5*a* from the resin tube 5. This eliminates the labor involved in cutting the sealed portion 5*b* by a cutter or the like and makes it possible to reliably separate the individual bag 5*a* from the resin tube 5 in a state where both are sealed. At the same time, since the fusing and separating processes are performed by mechanical operations, a continuous packaging activity can be performed quickly and accurately.

Furthermore, since it is possible for the next batch of articles to be received by fusing the resin tube, separating the individual bag 5*a* from the tube and receiving the articles in the resin tube 5 can be performed simultaneouysly. Thus, the efficiency of the packaging operation can be enhanced by superimposing two packaging cycles, namley the step of separating the individual bag 5*a* and the step of receiving the articles.

Moreover, since a predetermined number of articles are packaged and handled in bag units, it is easy to verify the quantity of articles, thereby preventing post-processing problems such as shortfalls and miscounts. In addition, large-and small-numbered lots can be packaged by setting the optical sensor 9 to a count desired by the user.

It should be noted that the articles handled by the invention are not limited to the springs 3 of the above-described embodiment, for other articles such as foodstuffs can also be packaged.

Further, the moving means correspond to the guide shafts 13, slide plate 14, support plates 15, gears 16, 17, belt 18, drive motor 19 and air cylinder 20. However, the invention is not limited solely to the construction of the embodiment.

I claim:

1. A method for the continuous production of filled and sealed resinous containers comprising the steps of:

feeding a resinous material onto a generally tubular cassette having an upper portion of an outside diameter, said upper portion communicating with a charging station, and a bulbous lower portion having a widest outside diameter that is greater than the outside diameter of said upper portion;

retaining said resinous material on said cassette by a retainer ring surrounding said cassette and located generally near said bulbous portion;

applying heat to said resinous material by means of moveable heat press plates such that said resinous material is sealingly bound to itself in an area;

moving said heat press plates downwardly to pull said resinous material and separate said resinous material in said area such that said resinous material is sealingly bound to itself above and below the point of separation, said area being exposed to the downward force from the movement of said heat press plates and the upward force of said retainer ring and said bulbous portion said generally opposing upward and downward forces facilitating said separation of said resinous material in said area;

removing said heat press plates from said resinous material such that the portion of said resinous material pulled apart from said area is dropped away and said heat press plates return to a position near said cassette.

2. The method of claim 1 further comprising the steps of pinching said resinous material together below said bulbous portion of said cassette by means of moveable heat press plates;

pulling said resinous material downwardly with said heat press plates to pull said resinous material through said retainer ring;

said steps occurring after said retaining step and before said applying step.

3. The method of claim 2 wherein prior to said pinching step said resinous material is charged with filling said filling being sealed in said resinous material after said applying heat step.

4. An article packaging apparatus for the continuous production of filled and sealed resinous containers, said apparatus being connected between a charging station and a removal station and comprising:

a generally tubular cassette having an upper portion with an outside diameter of a first dimension, said upper portion communicating with said charging station, said tube cassette also having a bulbous lower portion opposite said upper portion, said bulbous lower portion having a widest outside diameter that is greater than the outside diameter of said upper portion, said resinous material surrounding said cassette and extending below said bulbous lower portion;

a retainer ring surrounding said resinous material and located near said bulbous portion, said retainer ring being used to hold said resinous material on said cassette;

moveable heat press plates for pinching and heat sealing said resinous material together, said moveable heat press plates being operable with said bulbous portion and said retainer ring such that after applying heat and pressure to said resinous material said moveable heat press is moved downwardly against the force of said retainer ring and said bulbous portion to thereby result in the separation of a portion of said resinous material said separated portion of said resinous material having been sealed by said heat press plates both below and above the point of separation.

5. The article packaging apparatus of claim 4 wherein there are a first and a second moveable heat press plates oppositely located, said first heat press plate having a clamping surface of a first configuration, said second heat press plate having a clamping surface of a second configuration which mates with the clamping surface of the first configuration.

* * * * *